US005912692A

United States Patent [19]

Kuehnle

[11] Patent Number: 5,912,692

[45] Date of Patent: Jun. 15, 1999

[54] PRINTING DEVICE WITH M-TUNNEL WRITE HEAD

[75] Inventor: Manfred R. Kuehnle, New London, N.H.

[73] Assignee: Heidelberger Druckmaschinene AG, Heidelberg, Germany

[21] Appl. No.: 08/791,975

[22] Filed: Jan. 31, 1997

[51] Int. Cl.[6] ..... B41J 2/415

[52] U.S. Cl. ..... 347/123

[58] Field of Search ..... 347/123, 115, 347/113, 128; 358/300

[56] References Cited

U.S. PATENT DOCUMENTS 4,792,860 12/1988 Kuehnle ..... 347/88
5,325,120 6/1994 Kuehnle ..... 347/113
5,343,234 8/1994 Kuehnle ..... 347/128
5,406,314 4/1995 Kuehnle ..... 347/115

*Primary Examiner*—N. Le
*Assistant Examiner*—L. Anderson
*Attorney, Agent, or Firm*—Kenyon & Kenyon

[57] ABSTRACT

A device for recording an image includes a recording surface and a write head positioned next to the recording surface. The write head has at least one microtunnel, with each microtunnel having an anode placed near the recording surface and a cathode located further away from the recording surface than the anode, so as to permit generation of a gas plasma between the anode and the cathode. A voltage source varies the voltage of the anode so as to permit recording of the image on the recording surface. In another embodiment, an additional anode is located near the cathode further away from the recording surface than the first anode.

20 Claims, 5 Drawing Sheets

PRINTING DEVICE WITH M-TUNNEL WRITE HEAD

FIELD OF THE INVENTION

The present invention relates to write heads for printing presses and the like, and more particularly to write heads using microplasma to contact a recording surface of a print cylinder.

BACKGROUND OF THE INVENTION

Various types of write heads for charging the surface of a print cylinder are known, for example write heads employing lasers, light-emitting diodes or heat. Also known are microtunnel (M-tunnel)write heads, where the write head induces a strong electrostatic field within a defined volume and forms a microplasma of positive ions for contacting and charging the recording surface. The resultant charges correspond to a desired image which is to be printed, typically after the charged recording surface attracts ink or toner after passing an inking station.

The M-tunnel process is described, for example, in U.S. Pat. No. 5,325,120. In the M-tunnel write head shown in the '120 patent, a small needle-shaped electrode is placed at the top of each of a plurality of microtunnels. This anode accepts positive voltage pulses which generate positive ions. The positive ions are attracted toward a recording surface by a ring-like gate electrode or cathode placed in the tunnel wall near the bottom of the microtunnel, the gate electrode having the voltage to which the recording surface should be charged. A grounded substrate is provided under the dielectric recording surface to further attract the positive ions. The ions accumulate on the recording surface until they reach the voltage potential of the gate electrode, thereby charging the recording surface and permitting the surface to attract ink at a later point in the print process.

The M-tunnel structure described in the '120 patent however has several disadvantages. First, the distance between the ion-generating needle-shaped anode and the write surface creates an electrical resistance which requires a large potential at the anode for desired charges to accumulate on the write surface. Second, the needle-shaped anode may become very hot when generating the plasma. Third, the pixel "footprint" left on the recording surface is strongly defined by the cross-sectional shape of the microtunnel at its exit near the recording surface.

SUMMARY OF THE INVENTION

The present invention therefore provides a printing unit having a recording surface and a write head positioned next to the recording surface, the write head comprising at least one microtunnel. Each microtunnel has an anode placed near the recording surface and a cathode located further away from the recording surface than the anode, so as to permit generation of a gas plasma between the anode and the cathode. A voltage source varies the anode voltage according to an image to be recorded on the recording surface.

The anode thus scavenges electrons from the plasma, leaving an excess of positive ions near the anode, as described in U.S. Pat. No. 5, 325,120, which is hereby expressly incorporated by reference herein. While many positive ions are attracted to the cathode, some also are attracted to the recording surface by the close proximity of the recording surface, which has a grounded or constant low voltage plane underneath it. The recording surface may be comprised of a dielectric material. The recording surface thus is charged according to a desired image to be recorded, as described, for instance, in the '120 patent. In the present invention, however, the voltage at the anode varies according to the desired charge to be deposited on the recording surface. The voltage at the cathode also may vary, it being possible to keep the voltage difference between the anode and cathode at an essentially constant level to ensure proper plasma formation.

The positioning order of the anode and cathode of the present invention within the microtunnel are therefore reversed from those of other devices. The proximity of the anode to the writing surface in the present invention reduces the necessary writing voltage at the anode.

By placing the anode in very close proximity to the recording surface, "edge recording" also is possible, so as to permit the resolution of a pixel in the direction of movement of the recording surface to be independent from the microtunnel shape in that direction. The resolution in the direction of movement may be determined by the electrical frequency with which the writing takes place.

A grounded layer may be provided underneath the recording surface. Alternatively, this lower layer could be charged to a voltage lower than the anode voltages.

The anode of the present invention may also be embedded within the microtunnel walls, preferably in the form of a wire which has a square or thick end. This embedding permits polishing of the electrode surface and may reduce heating of the anode surface. With the embedded wire structure, the microtunnels also are easier to manufacture.

In another embodiment of the present invention, an additional electrode is placed even further away from the cathode, so as to permit plasma generation at the additional electrode as well. The voltage between the additional electrode and the cathode can thus remain constant, and only the voltage at the anode close to the writing surface need vary, according to the image desired to be recorded on the recording surface.

Instead of a DC voltage source, it is also possible to use an AC voltage source, so that positive and negative charges are deposited on the recording surface, alternating in the direction of motion of the recording surface. An electric field above the recording surface between the positive and negatively charged areas thus arises.

DESCRIPTION OF THE DRAWINGS

The description of the embodiments of the present invention may be made with reference to the following drawings, in which.

DETAILED DESCRIPTION

Figure 1:
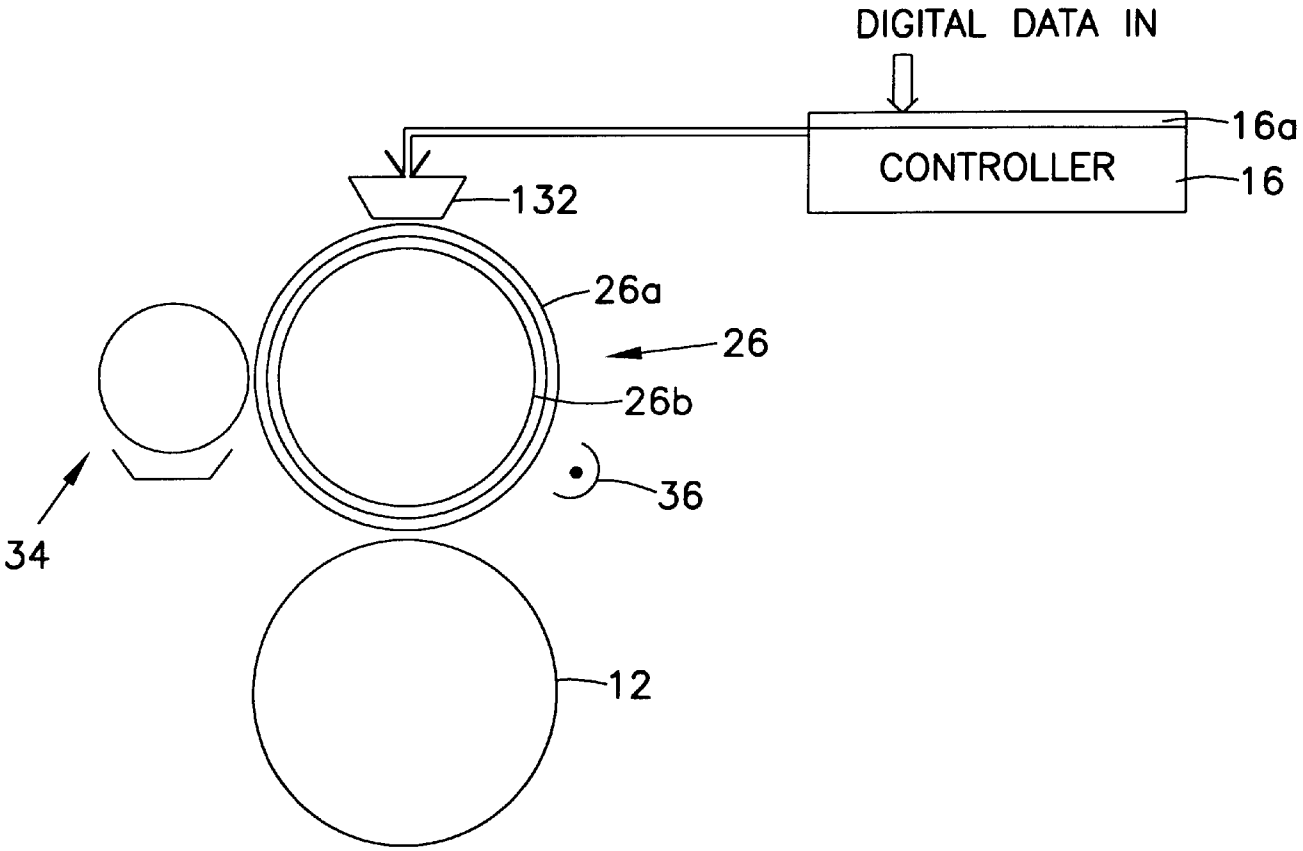
FIG. 1 shows a schematic view of the print mechanism of the present invention.

FIG. 1 shows a print unit of the present invention. Digital data representing an image to be recorded on a recording surface is fed into a controller 16, which preferably has a mass memory 16*a*. The controller 16 controls an M-tunnel write head 132, which is positioned in close proximity above a print cylinder 26 having a recording surface 26*a*. The write head 132 extends the entire operating width of the print cylinder 26, and comprises a plurality of M-tunnels for writing electric charges corresponding to the digital data on the recording surface 26*a*. The recording surface 26*a* is formed of a dielectric material. Underneath the recording surface is a backing layer 26*b*, which may be grounded or in the alternative adjusted to a constant level.

As the print cylinder 26 rotates, the charges recorded on the print cylinder surface 26*a* pass an inking or toner station 34 where the charges attract ink or toner. The ink or toner station may be a four-color inking head or may hold only a single color. If four-color printing is desired and only one color is provided per inking station, a series of four print units may be provided, each unit printing one color. Typically the colors cyan, magenta, yellow and black are provided for four-color printing.

After the ink or toner is attracted at the ink station 34, it is deposited on a sheet or web of paper which contacts the print cylinder 26 at a nip formed between the print cylinder 26 and an impression cylinder 12. An erasing station 36 then erases any remaining charges or ink on the recording surface 26a before new charges are written on the recording surface by the write head 132. A similar print unit having a differently structured M-Tunnel write head also is described in already incorporated-by-reference U.S. Pat. No. 5,325,120.

Figure 2:
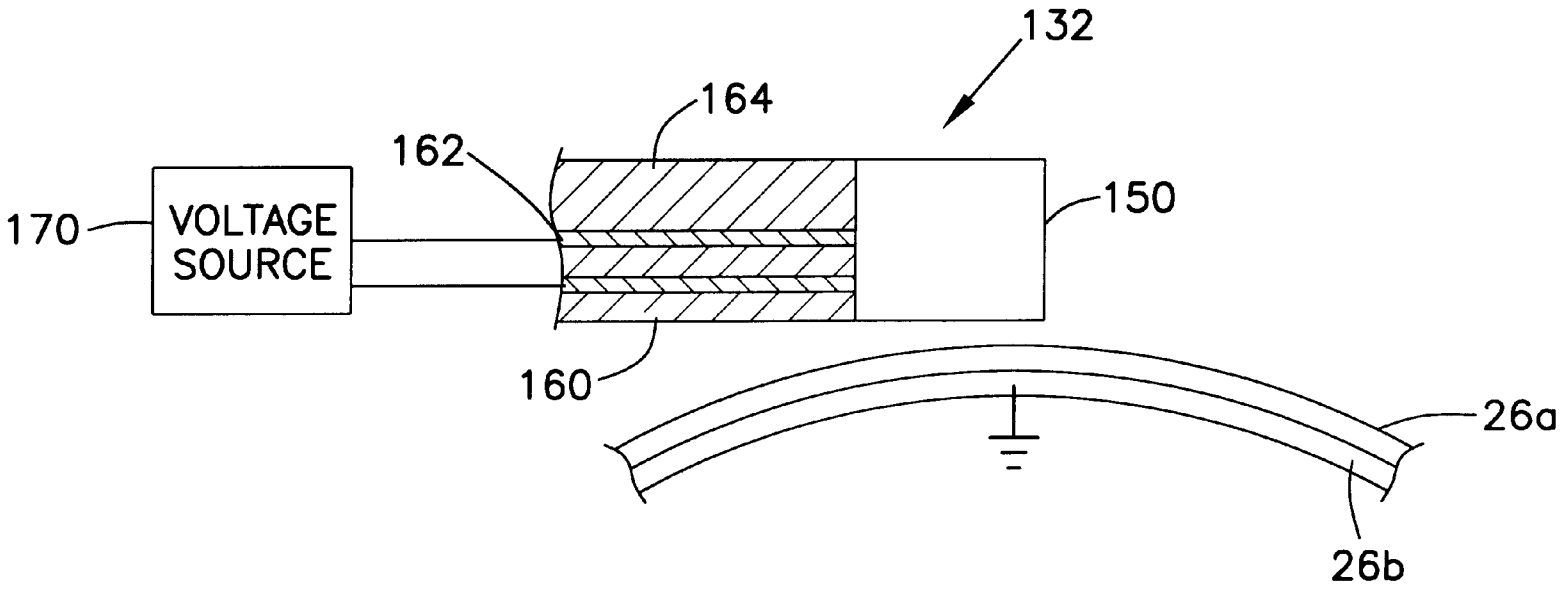
FIG. 2 shows a cross-sectional view of one embodiment of the microtunnel write head of the present invention, located next to the recording surface.

FIG. 2 shows a cross-section of an individual M-tunnel 150 of the write head 132. The M-tunnel 150 is located just above the recording surface 26*a* of the print cylinder 26, which also has a ground or backing layer 26*b* located underneath the recording surface 26*a*. An anode 160 is embedded in a back plate 164 of the microtunnel near the recording surface 26*a*. The anode 160 preferably is placed as close as possible to the recording surface 26*a* to promote charge deposition. However, the anode remains electrically insulated within the M-tunnel and the M-tunnel preferably does not physically contact the recording surface 26*a*, so that the distance between the anode 160 and the recording surface 26*a* will depend on several factors, including manufacturing tolerances of the various components. A cathode 162 is also embedded in the back plate 164, although further away from the recording surface 26*a* than the anode 160. The anode 160 preferably comprises a rectangular or square cross-sectioned wire, as does the cathode 162.

A voltage supply source 170 is connected to the anode and the cathode, and can modulate the potential between the cathode 162 and anode 160 according to instructions it receives from the controller 16 (FIG. 1). During operation, a plasma forms between the anode 160 and cathode 162, and positive ions are attracted not only to the cathode 162, but also to the recording surface 26*a* because of a lower potential at the backing layer 26*b*. Therefore, by varying the voltage at the anode 160, charges corresponding to an image may be written on the recording surface 26*a*, which is made of a dielectric material, such as sapphire or cadmium sulfide. The charges are held on the recording surface 26*a* until they attract ink or toner from an inking station 34, as shown in FIG. 1. The ink or toner is then transferred to a web or sheet of material, typically paper. As the voltage at the anode 160 varies, the voltage at the cathode 162 may be periodically adjusted as well, so as to retain a sufficient potential difference between the anode 160 and the cathode 162 to permit plasma formation.

Figure 2A:
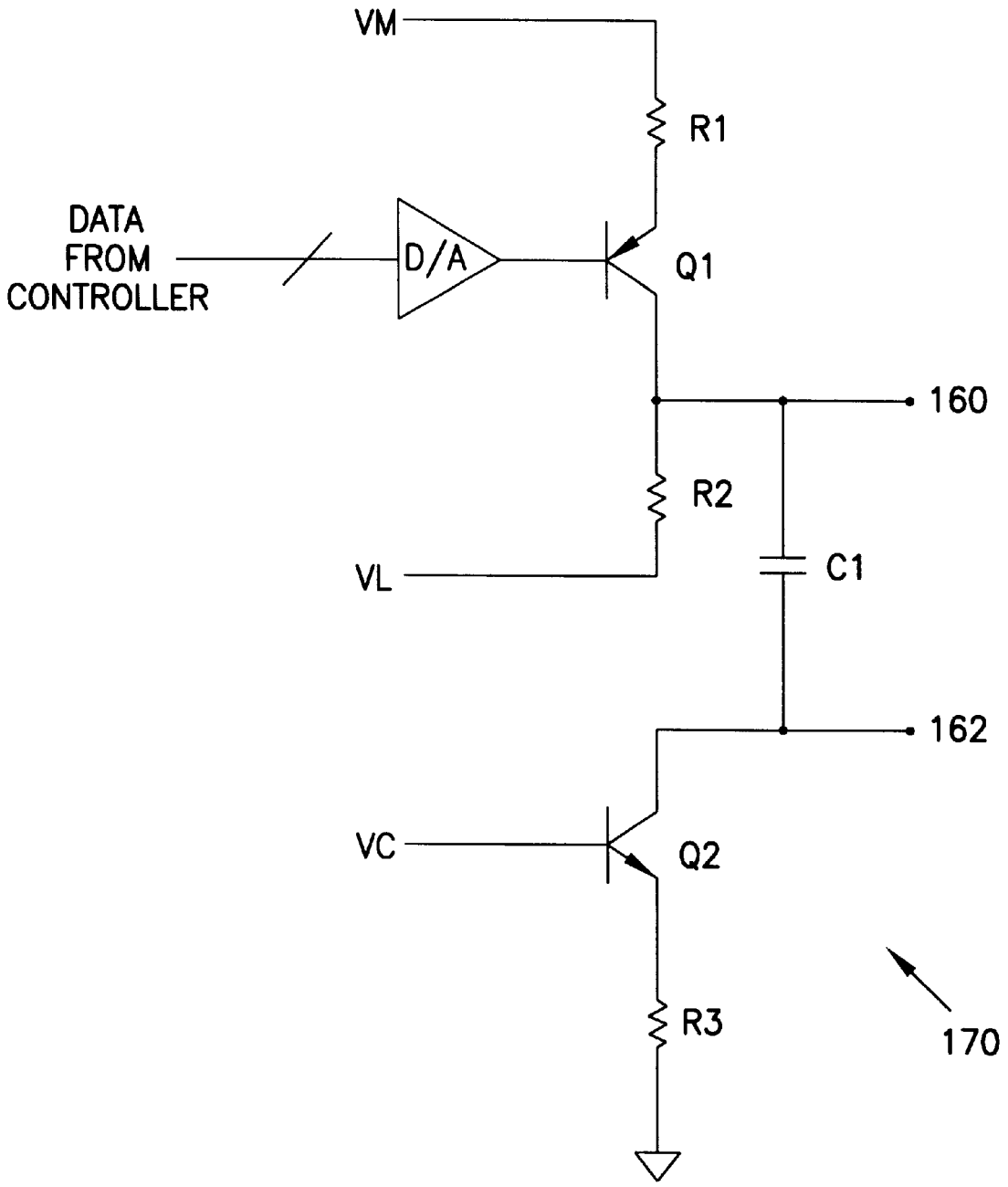
FIG. 2*a* shows a schematic of one embodiment of the voltage source.

FIG. 2*a* shows possible circuitry associated with one embodiment of the voltage source 170 for a single M-Tunnel. Each M-Tunnel 150 has a separate drive circuit on a head driver board which may contain 128 M-Tunnels. The cathode 162 may be controlled by an adjustable constant current source, having a voltage VC, a transistor Q2 and a resistor R3. VC may be adjustable, for example, between 0 and 12 volts, and R3 may be 13K ohms. The anode 160 is voltage controlled and its voltage may swing between voltages VL and VM in correspondence with the pixel data from the controller of the image being printed. The voltages VL and VM may, for example, be 300 and 460 volts respectively. Resistors RI and R2 may be 1500 ohms and 100K ohms, and a transistor Q1 may be located as shown. The voltage on the backing layer 26*b* may be adjustable, but can generally be held 20 to 50 volts below the minimum anode voltage. However, the backing layer may also be grounded.

The width of the microtunnels are generally about 50 micrometers, so as to correspond to a typical pixel width. A noble gas such as argon may be circulated through the microtunnels to provide a source of ions and for cooling purposes.

Figure 3:
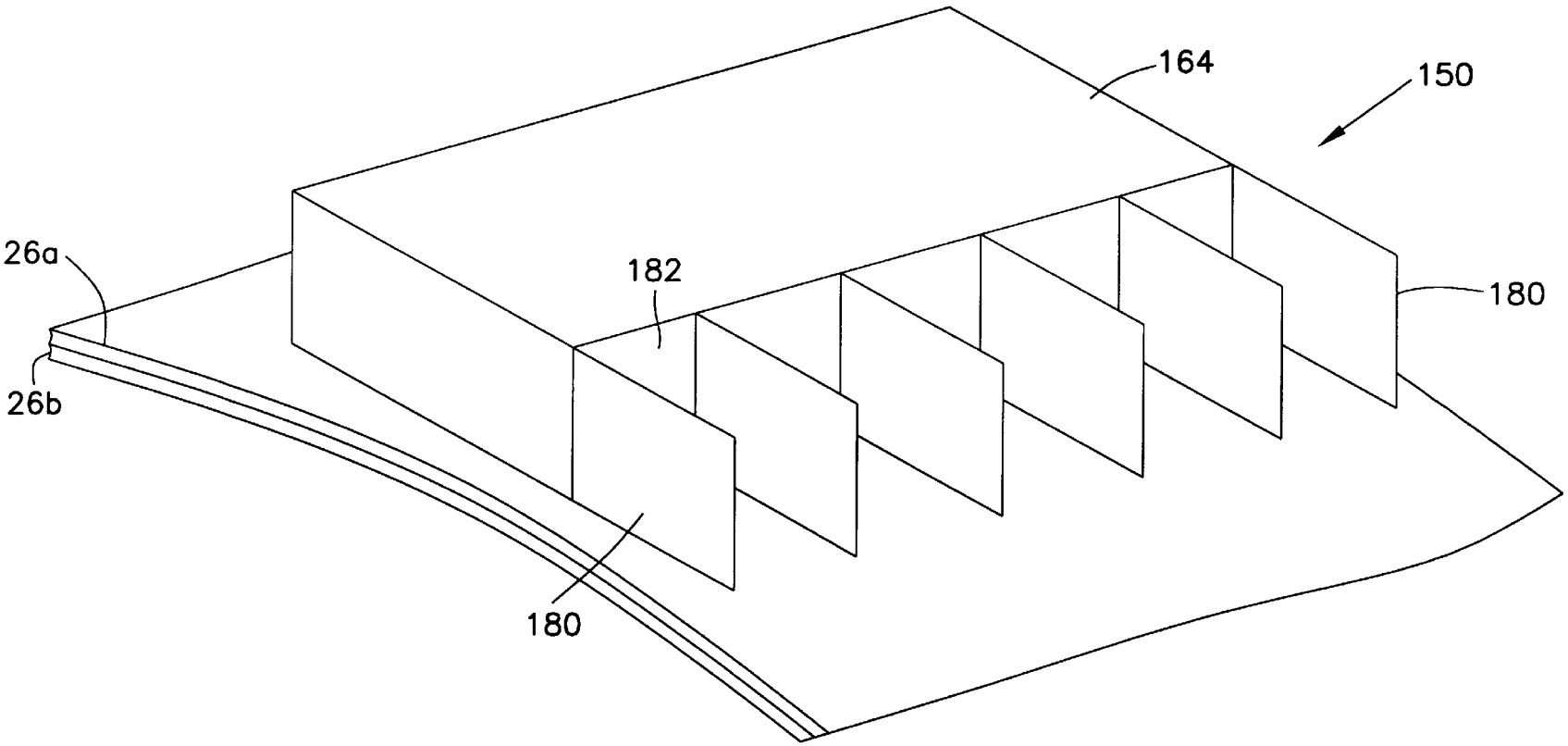
FIG. 3 shows the microtunnel write head of FIG. 2 from an angled top view.

Unlike previous microtunnel devices, the microtunnels of the present invention are not limited in the direction of movement of the recording surface 26*a*. The M-tunnels 150 therefore may be formed as 3-sided slits which are open from top to bottom, as shown in FIG. 3, which shows a few the microtunnels 150 (typically there are many more extending the entire width of the print cylinder) arranged side by side from an angled top view. Each microtunnel has side walls 180 and a back wall 182 of the back plate 164, where the anode 160 and cathode 162 are located. The back wall 182 may be polished, so that the wire ends of the anode 160 and cathode 162 (FIG. 1) are smooth against the back wall 182. The side walls 180 and back wall 182 are formed of a material which electrically insulates the wires. An electrolytically deposited porous oxide, such as $Al_2O_3$ crystallites, optionally could be deposited on the walls to promote electron formation under very high electrostatic fields while still preventing a short between the wires. The M-tunnels also may have a front wall (not shown), so as to form 4-sided closed structures.

The microtunnels of the present invention permits "edge" recording on the recording surface 26*a*. While each pixel is limited in the direction perpendicular to the movement of the recording surface 26*a* by the physical width of the microtunnel 150, while in the direction of movement of the recording surface 26*a*, the pixel size is not limited by the microtunnel structure. However, the back wall 182 does charge electrostatically to repel ions and causes them to stay within the pixel territory.

Figure 4:
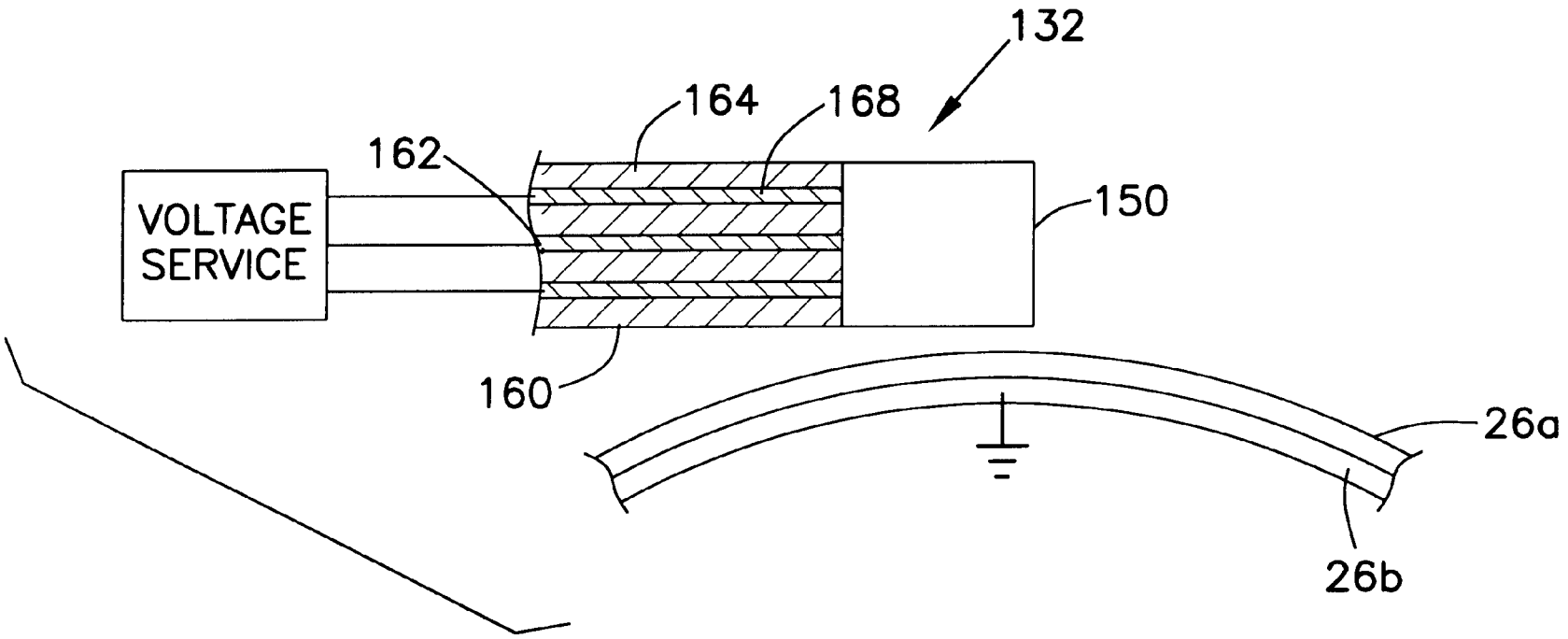
FIG. 4 shows a cross-sectional view of another embodiment of the microtunnel write head having three electrodes.

As shown in FIG. 4, an embodiment having three electrodes within each microtunnel 150 of the write head 132 is also possible. This embodiment is similar to that shown in FIG. 2, but an additional anode 168 is placed further away from the cathode 162. The potential difference between the cathode 162 and additional anode 168 is then fixed to promote plasma generation, and only the anode 160 is modulated to write images on the recording surface 26*a*. Plasma thus forms between all three electrodes.

This embodiment also eliminates the need for varying the voltage of two electrodes, since only the voltage at the anode 160 need be varied. It is also possible to operate the anode 160 at relatively low voltages, since the additional anode 168 carries some of the plasma generating responsibility.

Other configurations with three electrodes are possible, such as a triangular arrangement where the additional anode

168 is placed to the side of the cathode 162, so long as the anode 160 remains the electrode closest to recording surface 26*a*.

While the voltage between the additional anode 168 and the cathode 162 remains fixed, it is also possible to use an AC, rather than the typical DC, voltage source at the anode 160.

The AC voltage source then provides varying voltages to the anode in accordance with the image to be reproduced. The voltages preferably alternate in a positive voltage range, which may be accomplished by adding a constant DC voltage to the AC voltage.

The write head may be used in a variety of devices in which an image is to be recorded, such as printing presses, copiers, fax machines, and the like.

What is claimed is:

1. A device for recording an image comprising:

a recording surface;

a write head positioned next to the recording surface, the write head comprising at least one microtunnel, each microtunnel having an anode placed near the recording surface and a cathode located further away from the recording surface than the anode, so as to permit generation of a gas plasma between the anode and the cathode; and a voltage source for varying the voltage of the anode so as to permit recording of the image on the recording surface.

2. The device as recited in claim 1 further comprising a constant voltage backing layer underneath the recording surface.

3. The device as recited in claim 1 wherein the recording surface comprises a dielectric material.

4. The device as recited in claim 1 wherein the recording surface has a direction of movement with respect to the at least one microtunnel and the at least one microtunnel includes a plurality of microtunnels arranged side-by-side perpendicular to the direction of movement.

5. The device as recited in claim 1 further comprising an inking station positioned next to the recording surface.

6. The device as recited in claim 1 wherein each microtunnel comprises a back wall and two side walls, the anode and the cathode being embedded in the back wall.

7. The device as recited in claim 1 wherein the voltage source provides a constant voltage between the anode and the cathode.

8. The device as recited in claim 1 wherein the voltage source comprises a DC voltage source.

9. The device as recited in claim 1 wherein the voltage source comprises an AC voltage source.

10. A device for recording an image comprising:

a recording surface;

a write head positioned next to the recording surface, the write head comprising at least one microtunnel, each microtunnel having:

a first anode placed near the recording surface;

a cathode located further away from the recording surface than the first anode; and an additional anode located further away from the recording surface than the first anode, so as to permit generation of a gas plasma between the anode and the cathode; and a voltage source for varying the voltage of the first anode so as to permit recording of the image on the recording surface.

11. The device as recited in claim 10 wherein voltage source provides a constant voltage between the cathode and the additional anode.

12. The device as recited in claim 10 wherein the additional anode is located further away from the recording surface than the cathode.

13. The device as recited in claim 10 further comprising a constant voltage backing layer underneath the recording surface.

14. The device as recited in claim 10 wherein the recording surface comprises a dielectric material.

15. The device as recited in claim 10 wherein the recording surface has a direction of movement with respect to the at least one microtunnel and the at least one microtunnel includes a plurality of microtunnels arranged side-by-side perpendicular to the direction of movement.

16. The device as recited in claim 10 further comprising an inking station positioned next to the recording surface.

17. The device as recited in claim 10 wherein each microtunnel comprises a back wall and two side walls, the first anode and the cathode being embedded in the back wall.

18. The device as recited in claim 10 wherein the voltage source comprises a DC voltage source.

19. The device as recited in claim 10 wherein the voltage source comprises an AC voltage source.

20. A device for recording an image comprising:

a recording surface;

a write head positioned next to the recording surface, the write head comprising at least one microtunnel each microtunnel having an anode placed near the recording surface and a cathode located further away from the recording surface than the anode, so as to permit generation of a gas plasma between the anode and the cathode;

the at least one microtunnel including a back wall and two side walls, the anode and the cathode being disposed at the back wall only, and a voltage source for varying the voltage of the anode so as to permit recording of the image on the recording surface.

* * * * *